United States Patent [19]

Walsh et al.

[11] Patent Number: 4,496,125

[45] Date of Patent: Jan. 29, 1985

[54] SUPPORT LEG ASSEMBLY

[75] Inventors: Thomas J. Walsh, Evanston; Robert Bachman, Highland Park, both of Ill.; Ronald Aderhold, Selden, N.Y.

[73] Assignee: Fiat Products Incorporated, Plainview, N.Y.

[21] Appl. No.: 411,618

[22] Filed: Aug. 26, 1982

[51] Int. Cl.[3] ..... F16M 11/20

[52] U.S. Cl. ..... 248/188; 108/156; 248/188.8; 312/256; 403/231

[58] Field of Search ..... 248/188, 188.8, 677, 248/163, 165, 150, 529; 108/156; 312/255, 256; 403/231, 245

[56] References Cited

U.S. PATENT DOCUMENTS

| | | | |
|---|---|---|---|
| D. 179,868 | 3/1957 | Trautvetter | D33/14 |
| 979,123 | 12/1910 | Rohrer . | |
| 1,709,406 | 4/1929 | Pond | 248/188 X |
| 1,870,173 | 8/1932 | Calton . | |
| 1,978,650 | 10/1934 | Shannon | 108/156 |
| 3,182,846 | 5/1965 | La Kaff | 108/156 X |
| 3,243,051 | 3/1966 | Ruhnke | 403/245 X |
| 3,333,282 | 8/1967 | Mustee | 4/187 |
| 3,687,092 | 8/1972 | Manning | 108/156 |
| 3,730,109 | 5/1973 | Kreizel et al. | 108/156 |
| 3,865,050 | 2/1975 | Cecchetti | 108/19 |
| 4,066,295 | 1/1978 | Severson | 297/443 |
| 4,119,045 | 10/1978 | Michelotti | 108/156 |

FOREIGN PATENT DOCUMENTS

| | | | |
|---|---|---|---|
| 220772 | 10/1957 | Australia | 108/156 |
| 2310109 | 5/1973 | France . | |
| 34243 | 11/1969 | German Democratic Rep. | 248/188 |
| 634899 | 2/1962 | Italy | 312/256 |

*Primary Examiner*—J. Franklin Foss
*Assistant Examiner*—David L. Talbott
*Attorney, Agent, or Firm*—Willian, Brinks, Olds, Hofer, Gilson & Lione Ltd.

[57] ABSTRACT

An improved supporting leg assembly for laundry tubs, tables and the like. A leg coupler having a tapered, substantially cylindrical socket containing a key therein is placed at each corner on the underside of the tub. A V-shaped leg, bearing a cylindrical tube affixed thereto on the inside of the V-leg at the end which contacts the tub, is placed at each corner of the tub with the tube engaging the socket. Each tube has a slot formed therein at the end which fits into the tubular socket, and the slot and key mate with each other when the leg is set in place. When assembled together, the tub and coupler are in load bearing contact with the top of each section of the V-leg and the top of the cylindrical tube, respectively. The V-legs may be tapered if desired.

29 Claims, 6 Drawing Figures

FIG. 1
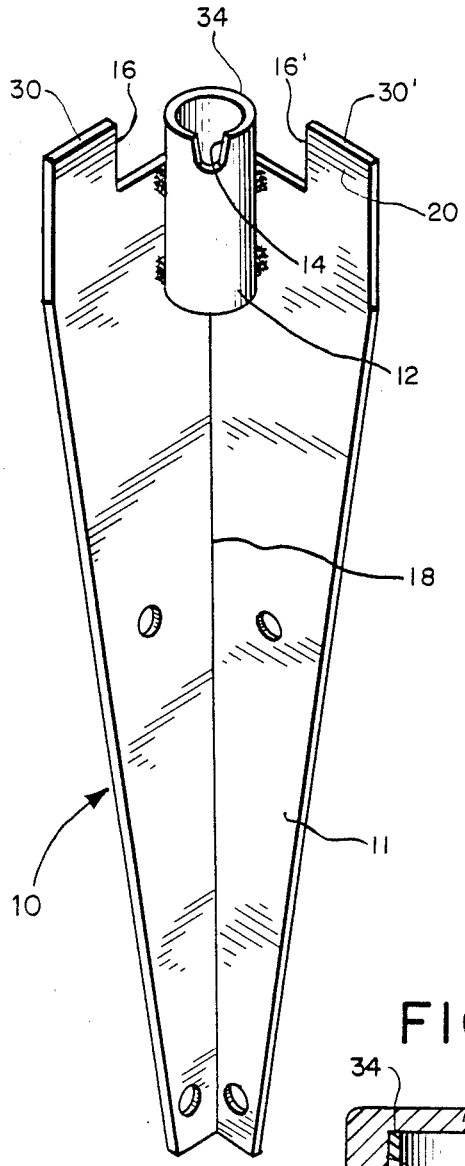
FIG. 3
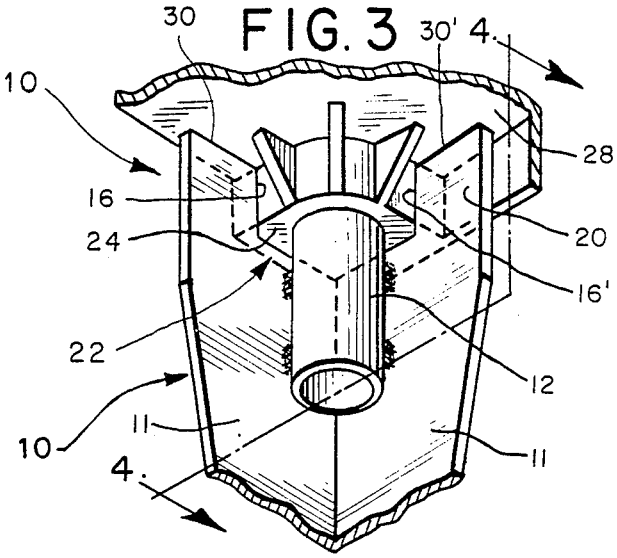
FIG. 2
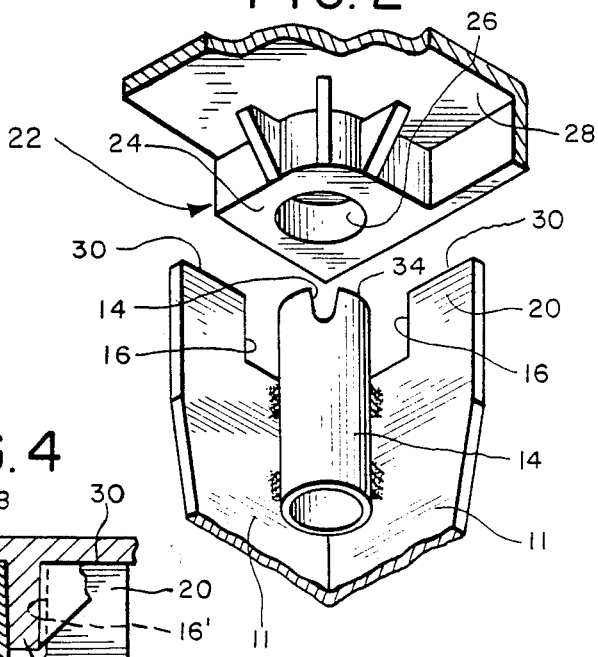
FIG. 4
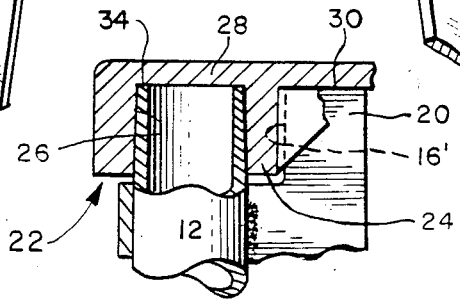
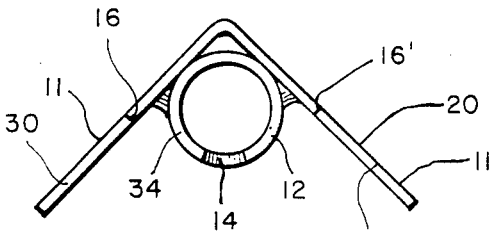
FIG. 1a
FIG. 2a
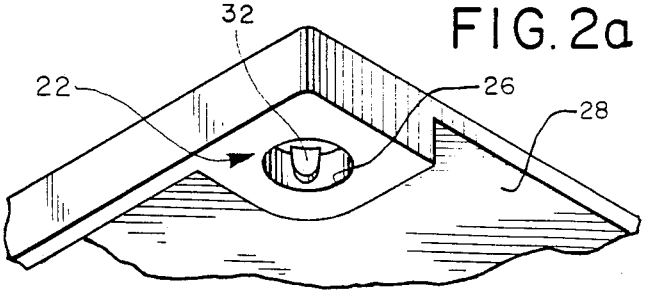

SUPPORT LEG ASSEMBLY

BACKGROUND OF THE INVENTION

This invention relates to an improved support leg assembly for containers, tables, and the like.

Containers such as laundry tubs and wash stands have for some time been provided with supporting legs of two general configurations. The first configuration includes supporting legs which are generally tubular. Such tubular legs are often attached to a laundry tub by inserting the leg into a socket defined in a lower surface of the tub. This arrangement is relatively easy to assemble. However, laundry tubs so supported are often susceptible to undesirable rocking due to the nature of the connection between the tubular leg and the tub, as well as due the flexibility of the leg itself.

A second approach which has been used in the past is to provide V-shaped, angular legs as supports for a laundry tub. Such V-shaped legs provide advantages in terms of increased rigidity and a more stable laundry tub. Often however, such V-shaped support legs are more difficult to mount to a laundry tub than the tubular legs discussed above. Furthermore, prior art V-shaped legs cannot readily be used with laundry tubs which define sockets for receiving tubular legs of the type described above.

The present invention is directed to an improved support leg assembly which can readily be mounted to a container, table or the like, and which provides improved stability to the object being supported.

SUMMARY OF THE INVENTION

According to this invention, a supporting leg is provided for use in combination with an object to be supported, wherein the object to be supported includes a leg coupler located at a lower surface thereof, which coupler defines a socket constructed to receive a tubular element. The supporting leg of this invention includes a longitudinally extending, elongated leg member having at least two longitudinal leg sections formed with an angle therebetween, such that each of the sections defines a respective end surface extending across a portion of the width to the leg member. A tube is attached to the leg member at one end thereof adjacent the end surfaces. This tube defines a tube end surface which extends across the width to the tube. The tube is sized and shaped to fit into the socket when the leg number is engaged with the leg coupler such that load bearing contact is made by the leg end surfaces against the lower surface of the object being supported, and load bearing contact is made by the tube end surface against an abutting surface of the socket.

The angular leg and tube cooperate to provide a leg assembly which is strong and which provides stable support for the object being supported. The leg assembly of this invention can be embodied in a low cost form which provides an attractive, massive appearance, yet which can be manufactured and installed with a small number of manufacturing steps. When used in conjunction with laundry tubs or sinks, the leg assembly of this invention provides a tub or sink which is steady and resistant to rocking. Furthermore, the leg assembly of this invention can be designed to fit into and engage leg couplers which are also used with standard tubular legs.

The invention itself, together with further objects and attendant advantages, will best be understood by reference to the following detailed description taken in conjunction with the accompanying drawings.

BRIEF DESCRIPTION OF THE DRAWINGS

FIG. 1 is a perspective view of a presently preferred embodiment of a supporting leg constructed in accordance with the present invention.

FIG. 1*a* is a top view of the support leg of FIG. 1.

FIG. 2 is a perspective of the top of the supporting leg of FIG. 1 as it is about to be set into a leg coupler positioned on a bottom corner of a laundry tub.

FIG. 2*a* is a perspective view of the bottom corner and leg coupler of FIG. 2 from another vantage point.

FIG. 3 is a perspective view of the supporting leg of FIG. 1 after it has been engaged with the coupler of FIGS. 2 and 3.

FIG. 4 is a sectional view taken along line 4—4 of FIG. 3.

DETAILED DESCRIPTION OF THE INVENTION

Referring now to the drawings, FIGS. 1 and 1*a* depict a preferred embodiment of a supporting leg 10 made in accordance with the present invention. As shown in FIGS. 1 and 1*a*, an elongated leg member 11 is provided which has an angle cross section, and which preferably is tapered from top to bottom to improve its aesthetic appearance. This leg member 11 carries a short length of a cylindrical tube 12, which is fixedly attached to the top of the leg member 11 inside the narrow portion or vertex 18 of the V-angle. A slot 14 is cut down from the top of the tube 12. Though the slot 14 is shown as being U-shaped here, other shapes, such as rectangular shapes, for example, may also be employed. The leg member 11 has a slot 16, 16' cut into the upper end of each leg section 11 starting from the vertex 18 and extending outward past the edges of the tube 12; the function of the leg slots 16, 16' will become apparent in connection with FIGS. 2, 3 and 4. The leg member 11 and the tube 12 are fabricated from a rigid material, for example a plastic, or a metal such as steel or iron. If metal is employed, the tube 12 may be fixedly attached to the leg member 11 by any suitable method, such as by welding at four points as shown in FIG. 1. The upper portion 20 of the side edge of each leg section 11 may be tapered or untapered—in the figures, it is shown untapered.

FIG. 2 shows the leg 10 about to be set in place in and around a leg coupler 22 which is fixedly mounted to a lower surface of a corner of an object 28 to be supported. In this example, the object 28 is a laundry tub. The leg coupler 22 may be molded simultaneously with the object 28 if the object is fabricated from a moldable material, or it may be made separately and attached to the leg corners of the object 28 by any suitable method, such as by welding or bolting. In this embodiment there is a leg coupler 22 for each corner of the object which is to be supported by a leg 10; ordinarily this will be four legs.

The leg coupler 22 includes a base 24 which defines a substantially cylindrical socket 26 formed therein. A key 32 is formed in the base 24 so as to extend into the socket 26, as shown in FIG. 2*a*. The key 32 fits into the tube slot 14 and prevents the tube 12 and therefore the leg 10 from twisting. The socket 26 is tapered preferably by 3 or 4 degrees, from bottom to top (i.e., from open end to closed end, the open end having the greater area) so that, when the tube 12 is inserted, a force fit is obtained. Some hammering may be necessary to force the tube 12 fully into the socket 26, but the dimensions of the socket 26 and base 24 in relation to the dimensions of the tube 12 and leg slots 16, 16' are such that the tube 12 fits fully into the socket 26 to permit the upper, or abutment edges 30, 30' of the leg sections 11 to make load bearing contact with the lower surface of the tub 28. When the tube 12 is inserted properly, as shown in FIGS. 3 and 4, three areas of load bearing contact are provided between the leg 10 by the object being supported, viz., the two upper end surfaces, or abutment edges 30, 30' of the leg member 11 contact the lower surface of the tub 28, and the upper end surfaces, or abutment edge 34 of the tube 12 contacts the surface of the base at the top of the socket. These three areas of contact provide firm, rigid support for the tub 28 by each leg 10 so as to prevent the tub 28 from rocking. The support leg assembly provides the further important advantages that it can be assembled quickly and easily without fasteners or the like, and the leg of this invention can be used in conjunction with standard leg couplers designed for use with tubular legs.

A novel type of support apparatus for supporting containers, tables and the like has been described which includes a leg, comprising a combination of a cylindrical tube and a leg member having an angle cross section, and a leg coupler attached to the bottom of the object to be supported. The leg member may or may not be tapered, various rigid materials may be employed for the leg and the leg coupler, and the dimensions may be varied. It should be understood that the tube can be affixed to the leg member on the outside rather than the inside of the angle and that the leg member can have more than two angled leg sections; for example, it can have three leg sections where two side leg sections are at opposed ends of and are perpendicular to a center leg section.

It is therefore intended that the foregoing detailed description be regarded as illustrative rather than as limiting, and that it be understood that it is the following claims, including all equivalents, which are intended to define the scope of this invention.

We claim:

1. A supporting leg for use with a leg coupler which defines a socket within a base located at a lower surface of an object to be supported, the socket being constructed to receive a tubular element, said supporting leg comprising:

a longitudinally extending, elongated leg member having at least two longitudinal leg sections joined together with an angle therebetween, each of said sections defining a respective end surface extending across a portion of the width of the leg;

a tube attached to said leg member at one end thereof adjacent the end surfaces and defining a tube end surface extending across the width of the tube;

said tube sized and shaped to fit into said socket when said supporting leg is engaged with said leg coupler such that load bearing contact is made by said leg end surfaces against the lower surface of said object to be supported and load bearing contact is made by the tube end surface against an abutting surface of said socket;

wherein each leg section is formed with a slot adjacent the respective leg end surface cut from the angle therebetween to a point along the width of the leg member sufficiently far from the angle to permit the slot to fit over the leg coupler and to allow said load bearing contacts to be made.

2. The invention of claim 1, wherein:

said socket is tapered such that the open end is greater in area than the closed end, the tapered socket providing force-fit contact with said tube when engaged therewith.

3. The invention of claim 1, wherein:

said leg member and tube are formed from rigid materials.

4. The invention of claim 1, wherein:

said leg member is formed with a downward taper therein.

5. An object-supporting apparatus for use with a container, table, or the like comprising:

a pair of leg sections, each comprising a flat length of rigid material, the leg sections being joined together at a vertex line to form a V-angle leg having a V-shaped cross section perpendicular to the length of the leg;

a tube affixed to the top of said leg inside the V-angle of the leg, said tube also being fabricated of a rigid material; and leg coupling means attached to a lower surface of an object to be supported and defining a socket therein, said socket adapted to receive the tube when said leg is set in place such that a first load bearing contact is made by the base of said socket against an upper edge of said tube and additional load bearing contacts are made by the lower surface of the supported object with upper edges of said V-angle leg, such that said first and said additional load bearing contacts are disposed in a common plane.

6. The invention of claim 5, wherein:

said tube is formed with a slot at the upper edge thereof and said socket is formed with a key therein, said key being positioned to fit into the tube slot in order to prevent said tube from twisting in said socket.

7. An object-supporting apparatus for use with a container, table, or the like comprising:

a pair of leg sections, each comprising a flat length of rigid material, the leg sections being joined together at a vertex line to form a V-angle leg having a V-shaped cross section perpendicular to the length of the leg;

a tube affixed to the top of said leg inside the V-angle of the leg, said tube also being fabricated of a rigid material; and leg coupling means attached to a lower surface of an object to be supported and defining a socket therein, said socket adapted to receive the tube when said leg is set in place such that load bearing contact is made by the base of said socket against an upper edge of said tube and load bearing contacts are made by the lower surface of the supported object with upper edges of said V-angle leg;

wherein each of said leg sections is formed with a slot at the upper edge thereof cut from the vertex line of the V-angle to a point along the upper edge sufficiently far from the vertex line to permit the slot to fit over the leg coupling means in order to allow said load bearing contacts to be made.

8. The invention of claim 5, wherein:

said socket is tapered such that the open end of the socket is greater in area than the closed end; the tapered socket providing force-fit contact with said tube when engaged therewith.

9. The invention of claim 5, wherein:

said leg, tube, and leg coupling means are fabricated from a metal.

10. The invention of claim 5, wherein:

said leg, tube, and leg coupling means are fabricated from a rigid plastic material.

11. The invention of claim 5, wherein:

said V-angle leg is formed with a downward taper therein.

12. The invention of claim 7 wherein:

said socket is tapered such that the open end of the socket is greater in area than the closed end, the tapered socket providing force-fit contact with said tube when engaged therewith.

13. The invention of claim 12 wherein:

the amount of said socket taper is about 3 to 4 degrees.

14. The invention of claim 7, wherein:

said tube is formed with a slot at the upper edge thereof and said socket is formed with a key therein, said key being positioned to fit into the tube slot in order to prevent said tube from twisting in said socket.

15. A supporting leg for use with a leg coupler which defines a socket within a base located at a lower surface of an object to be supported, the socket being adapted to receive a tubular element, said supporting leg comprising:

a leg member having a V-shaped cross section; and a cylindrical tube fixedly attached to the leg member at one end thereof, said tube constructed to fit into said socket, the dimensions of said tube and its location with respect to the nearby ends of said leg member being calculated to provide, when said leg member is set into place coplanar load bearing contacts between an upper edge of said tube and an abutting surface adjacent the socket, and between the upper edges of said leg member and the lower surface of said object.

16. The invention of claim 15 wherein:

said tube is formed with a slot at the upper edge thereof and said socket is formed with a key therein, said slot being shaped to receive the key to prevent said tube from twisting when engaged with said socket.

17. A supporting leg for use with a leg coupler which defines a socket within a base located at a lower surface of an object to be supported, the socket being adapted to receive a tubular element, said supporting leg comprising:

a leg member having a V-shaped cross section; and a cylindrical tube fixedly attached to the leg member at one end thereof, said tube constructed to fit into said socket, the dimensions of said tube and its location with respect to the nearby ends of said leg member being calculated to provide, when said leg member is set into place, load bearing contacts between an upper edge of said tube and an abutting surface adjacent the socket, and between the upper edges of said leg member and the lower surface of said object;

wherein the leg member is formed with a slot at the upper edge thereof cut from the vertex line of the V-shaped cross section to a point along the upper edge sufficiently far from the vertex line to permit the slot to fit over the base of the leg coupler in order to allow said load bearing contacts to be made between the upper edges of the leg member and the lower surface of said object.

18. The invention of claim 15, wherein:

said leg member is formed with a downward taper therein.

19. The invention of claim 15, wherein:

said leg member and tube are fabricated from a metal.

20. The invention of claim 15, wherein:

said leg member and tube are fabricated from a rigid plastic material.

21. The invention of claim 15, wherein:

said socket is tapered such that its open end is greater in area than its closed end, said tapered socket providing force-fit contact with said tube when engaged therewith.

22. The invention of claim 21, wherein:

the amount of said socket taper is in the range of about 3 to 4 degrees.

23. The invention of claim 17, wherein:

said leg member is formed with a downward taper therein.

24. The invention of claim 17 wherein:

said socket is tapered such that its open end is greater in area than its closed end, said tapered socket providing force-fit contact with said tube when engaged therewith.

25. The invention of claim 24, wherein:

the amount of said socket taper is in the range of about 3 to about 4 degrees.

26. The invention of claim 17 wherein:

said leg member is formed with a downward taper therein.

27. The invention of claim 17, wherein:

said tube is formed with a slot at the upper edge thereof and said socket is formed with a key therein, said slot being shaped to receive the key to prevent said tube from twisting when engaged with said socket.

28. A supporting leg for use with a leg coupler which defines a socket within a base located at a lower surface of an object to be supported, the socket being constructed to receive a tubular element, said supporting leg comprising:

a longitudinally extending, elongated leg member having at least two longitudinal leg sections joined together at a vertex line with a V-angle therebetween, each of said sections defining a respective end surface extending across a portion of the width of the leg, each of said leg sections formed with a slot at the upper edge thereof cut from the vertex line of the V-angle to a point along the upper edge to permit the slot to fit over the leg coupler such that the end surfaces abut the lower surface of the object to be supported;

a tube attached to said leg member at one end thereof adjacent the end surfaces and defining a tube end surface extending across the width of the tube;

said tube sized and shaped to fit into said socket when said supporting leg is engaged with said leg coupler such that load bearing contact is made by said leg end surfaces against the lower surface of said object to be supported and load bearing contact is made by the tube end surface against an abutting surface of said socket.

29. The invention of claim 28 wherein:

said tube is formed with a slot therein adjacent the tube end surface and said socket is formed with a key therein, said key being located so as to fit into said slot such that a single key and slot interlock will be effective to prevent said tube from twisting in said socket.

* * * * *